United States Patent [19]

Sommer et al.

[11] Patent Number: 4,749,419

[45] Date of Patent: Jun. 7, 1988

[54] METHOD FOR HEAT TREATING RAIL

[76] Inventors: Richard A. Sommer, 563 Adelaid; Michael R. Faber, 3996 Ravenwood, SE.; Reuel E. Jennings, 868 Shady La., NE., all of Warren, Ohio 44484

[21] Appl. No.: 900,996

[22] Filed: Aug. 28, 1986

[51] Int. Cl.[4] ..... C21D 1/18

[52] U.S. Cl. ..... 148/146; 148/153; 148/154

[58] Field of Search ..... 148/146, 150, 154, 145; 219/10.43, 10.61 R

[56] References Cited

FOREIGN PATENT DOCUMENTS 914645 3/1982 U.S.S.R. ..... 148/146

*Primary Examiner*—Christopher W. Brody

*Attorney, Agent, or Firm*—Fay, Sharpe, Beall, Fagan, Minnich & McKee

[57] ABSTRACT

A method and assembly for heat treating a railway rail is provided which maintains balanced thermal and metallurgical deformations about rail neutral axes during the heat treating process to produce a substantially straight rail with only minimal requirements for subsequent mechanical steps for distortion compensation. The method comprises the first step of preheating the overall rail including head, web and flange portions to a first preselected temperature below a metallurgical transformation temperature. A second step comprises heating rail head and flange portions to preselected temperatures above the metallurgical transformation temperature with a balanced thermal deformation about rail neutral axes. A third step comprises quenching the rail head and flange portions to produce a desired metallurgical structure in the rail head portion for improved wear characteristics while still maintaining a balanced thermal deformation about the axes. A fourth step comprises after-cooling the entire rail.

7 Claims, 3 Drawing Sheets

METHOD FOR HEAT TREATING RAIL

BACKGROUND OF THE INVENTION

The field of the subject invention includes apparatus and methods for the manufacture of railway rails, and more particularly to the hardening of high carbon steel rail by heat treatment.

The invention is particularly applicable to the hardening of rail by heat treatment through heating of the rail in a manner that achieves a balanced thermal deformation during the treatment for a rail product with a resultant straightness that considerably reduces the need for subsequent mechanical steps for distortion compensation. However, it will be appreciated to those skilled in the art that the invention could be readily adapted for use in other environments or for application to other items, for example, where similar heat treatment techniques are employed and product deformation is undesired.

Railway rail is typically comprised of high carbon steel. As trains have increased in size, power and weight, the increased loads on the rail, as well as increased traction and side thrust forces, have caused accelerated wear on the rail. The reduced life span of such rail has necessitated increased upkeep and replacement costs, more frequent inspections and substantial safety concerns.

Various forms and types of strengthened or hardened rail have been suggested and employed in the rail industry to overcome these problems, all with varying degrees of success. It has been found that the defects present in most prior proposals are such that the proposals themselves are of limited economic and practical value.

It is known to heat treat rail portions that are subject to the wear forces. Such heat treatment is applicable to high carbon or alloy steel rail. These methods suffer from the problem that metallurgical transformation, metallurgical volume changes, or thermal deformation in the rail will oftentimes require mechanical steps to compensate for the deformation of the rail. Such mechanical compensation steps are expensive and difficult to achieve, usually involve relatively large forces and limit the length of a rail that can be processed. In spite of this, subsequent straightening is required to produce an acceptable rail.

Other suggestions have comprised employing an alloy steel rail with better wear characteristics, but such a rail has the same properties throughout its volume and accordingly comprises a comparatively expensive rail. The increased expense of alloy rail has limited its applicability to situations where the cost can be justified.

Accordingly, there has been a long-felt need in the industry for improved apparatus and methods to produce railway rail having improved wear characteristics, but that can be produced at a cost below that of an alloy steel.

The present invention contemplates a new and improved apparatus and method for the hardening of high carbon steel railway rail which overcomes all of the above-referred to problems and others to provide a new method and assembly which is simple in design, economically hardens the rail where it is needed, is readily adaptable to a variety of rail dimensional characteristics and which provides a wear-resistant rail while reducing the need for subsequent mechanical steps for distortion compensation.

BRIEF SUMMARY OF THE INVENTION

In accordance with the present invention, there is provided a method and assembly for heat treating a railway rail to produce a rail with improved wear characteristics. The rail has head, web and flange portions disposed about vertical and horizontal neutral axes. The method comprises the first step of preheating the overall rail including the head, web and flange portions to a first preselected temperature below the metallurgical transformation temperature of the rail steel. A second step comprises heating the head portion and the flange portion of the rail to preselected temperatures above the metallurgical transformation temperature for a balanced thermal deformation of the rail about the axes. A third step comprises quenching the rail head and flange portions to produce a desired metallurgical structure in the rail with improved wear characteristics while achieving a balanced thermal deformation of the rail about the axes during the quenching process. The quenching process involves reducing the temperatures of the rail head and flange portions to a temperature below the metallurgical transformation temperature. A fourth step in the method comprises aftercooling the entire rail to room temperature, while maintaining a balanced thermal deformation about the neutral axes. The balanced thermal deformation of the entire rail head, web and flange portions allows for hardening of the rail while producing a rail having a substantial straightness, and thereby reduces the need for subsequent mechanical distortion compensation processing.

In accordance with another aspect of the subject invention, the preheating step comprises an overall heating of the rail to a temperature of approximately 1000° F. . Following this, the head portion and the flange portion are heated to temperatures above the metallurgical transformation temperature namely $A_s$ for any alloy of steel. Preferably induction heating techniques are employed to achieve the balanced thermal deformation about the rail neutral axes. The third step of quenching the head and flange portions comprises a localized air quenching of the head and flange portions to approximately 1000° F. An overall spray quench is used to then reduce the temperature of the hardened rail to ambient room temperature.

In accordance with the present invention an assembly is provided for the above-described method. The assembly comprises a preheat induction coil disposed in association with the rail for generally overall through heating of a rail section to a first preselected temperature below a rail metallurgical transformation temperature. Subsequent to the overall preheating, a rail head induction heating coil and rail flange induction heating coil are disposed for heating the head portion and the flange portion, respectively, to preselected temperatures above the rail metallurgical transformation temperature. Means for quenching and cooling the heated rail are subsequently disposed and operatively controlled about the rail to provide a generally balanced thermal deformation of the rail during heating, quenching, and cooling to provide a hardened and wear-resistant straight rail.

One benefit obtained by use of the present invention is a railway rail having improved wear characteristics obtained by improved heat treating methods.

Another benefit of the subject invention is a method and assembly for obtaining heat treated and hardened high carbon steel rail that is substantially straight, thus reducing the need for subsequent processing steps for mechanical distortion compensation.

A further benefit of the present invention is a method and assembly for heat treating high carbon railway rail which limits residual stress formation in the rail upon heat treatment.

Yet another benefit of the present invention is the ability to process unlimited length of rail as opposed to prior methods which are limited by physical restraints to relatively short lengths.

Other benefits and advantages for the subject new method and assembly will become apparent to those skilled in the art upon a reading and understanding of this specification.

BRIEF DESCRIPTION OF THE DRAWINGS

The invention may take physical form in certain parts and arrangements of parts, and in certain steps and arrangements of steps, the preferred embodiments of which will be described in detail in this specification and illustrated in the accompanying drawings which form a part hereof and wherein.

DETAILED DESCRIPTION OF THE INVENTION

Figure 1:
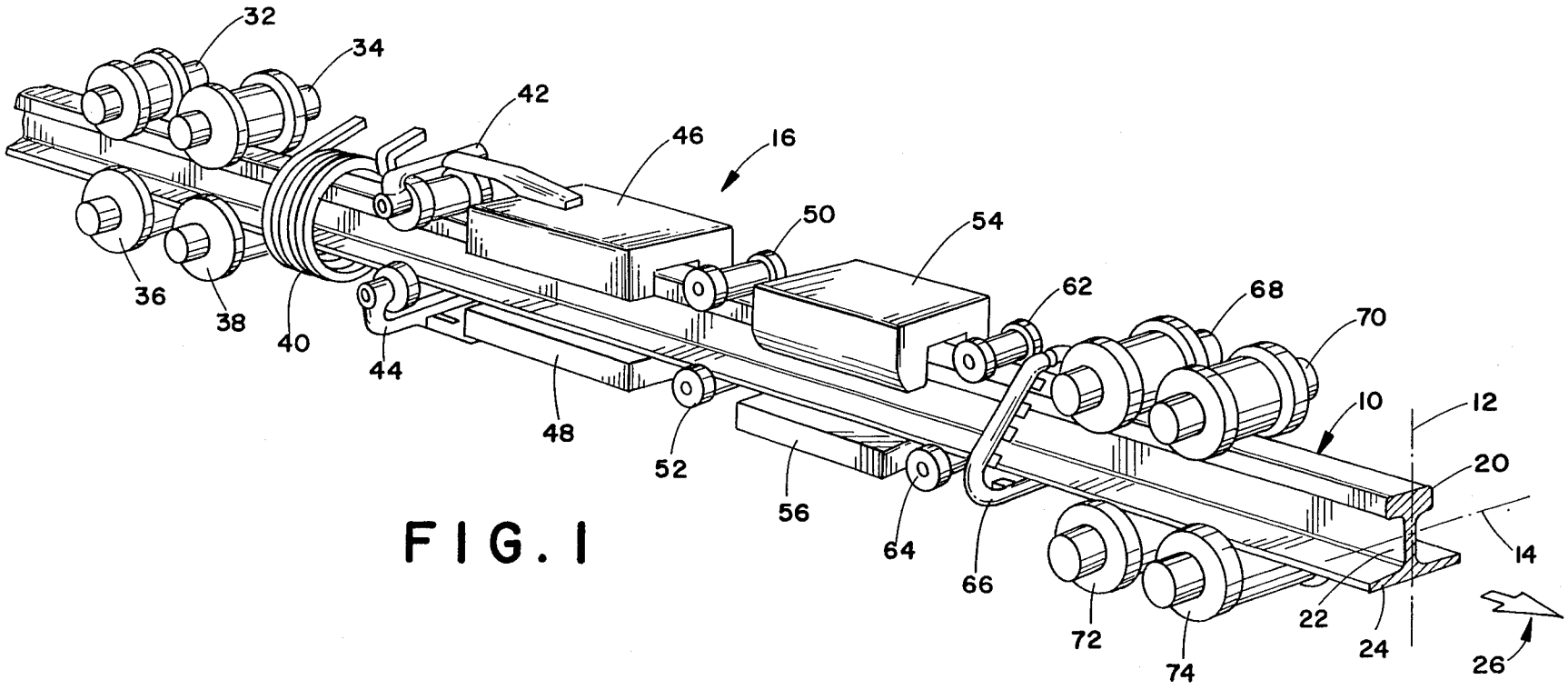
FIG. 1 is a perspective view of a rail heat treating assembly formed in accordance with the present invention, showing a railway rail passing through the assembly.

Referring now to the drawings wherein the showings are for purposes of illustrating the preferred embodiments of the invention only and not for purposes of limiting same, a railway rail 10 having a vertical neutral axis 12 and a horizontal neutral axis 14 is received for hardening by heat treatment in a heat treating assembly 16 to provide a rail with improved wear characteristics. More specifically and with reference to FIG. 1, the rail 10 has a head portion 20, a web portion 22, and a flange portion 24 in accordance with conventional rail constructions. The rail is preferably integrally formed of a high carbon steel.

Since a typical rail 10 has a long length, the subject invention envisions the rail relatively passing through the assembly 16in a manner as shown by the arrow 26 of the Figure when the assembly 16 is secured to a frame (not shown) fixed relative to moving rail 10. Alternatively, the assembly 16 could be fixed to a rolling frame (not shown) which could be then be passed along a fixed rail 10. In either method described above, the direction of relative motion between the rail 10 and the heat treating assembly 16 is as shown by the arrow 26.

In order of exposure of the rail 10 to the heat treating assembly 16, a rail portion will first be located for general alignment of the rail relative to the assembly 16 preferably by pinch rollers 32, 34, 36, 38. A preheat induction coil 40 fed by a source of electrical energy (not shown) preheats the rail 10 to a temperature below the metallurgical transformation temperature of the rail as will hereafter be more fully discussed. Guide means such as rolls 42, 44 in respective association with a rail head inductor 46 and an oppositely-disposed base or flange inductor 48 align the inductors 46, 48 for substantially simultaneously heating the head portion 20 and the flange portion 24 up to preselected temperatures above the metallurgical transformation temperature to effect a metallurgical transformation in the rail and ultimately produce a hardened rail head. Heating of the rail head portion and the flange portion in a substantially simultaneous manner results in a balanced thermal deformation of the rail about the neutral axes 12, 14 and avoids thermal or metallurgical deformation of the rail to the extent to cause the rail to bend or curve out of an acceptable straightness. Guide means such as rolls 50, 52 align a head quench 54 and a flange quench 56 which operate to reduce the head and flange portion temperatures by air quenching to a temperature below the metallurgical transformation temperature of the rail. The controlled heating and quenching of the rail head effects the hardening of the rail head to achieve the improved wear characteristics desired for a railway rail.

Guide rolls 62, 64 align a water spray cool down 66 which reduces the temperature of the rail 10 to approximately room temperature. Guide rolls 68, 70, 72, 74 will lastly serve as alignment aids for the rail passing from the heat treating assembly 16.

Figure 2:
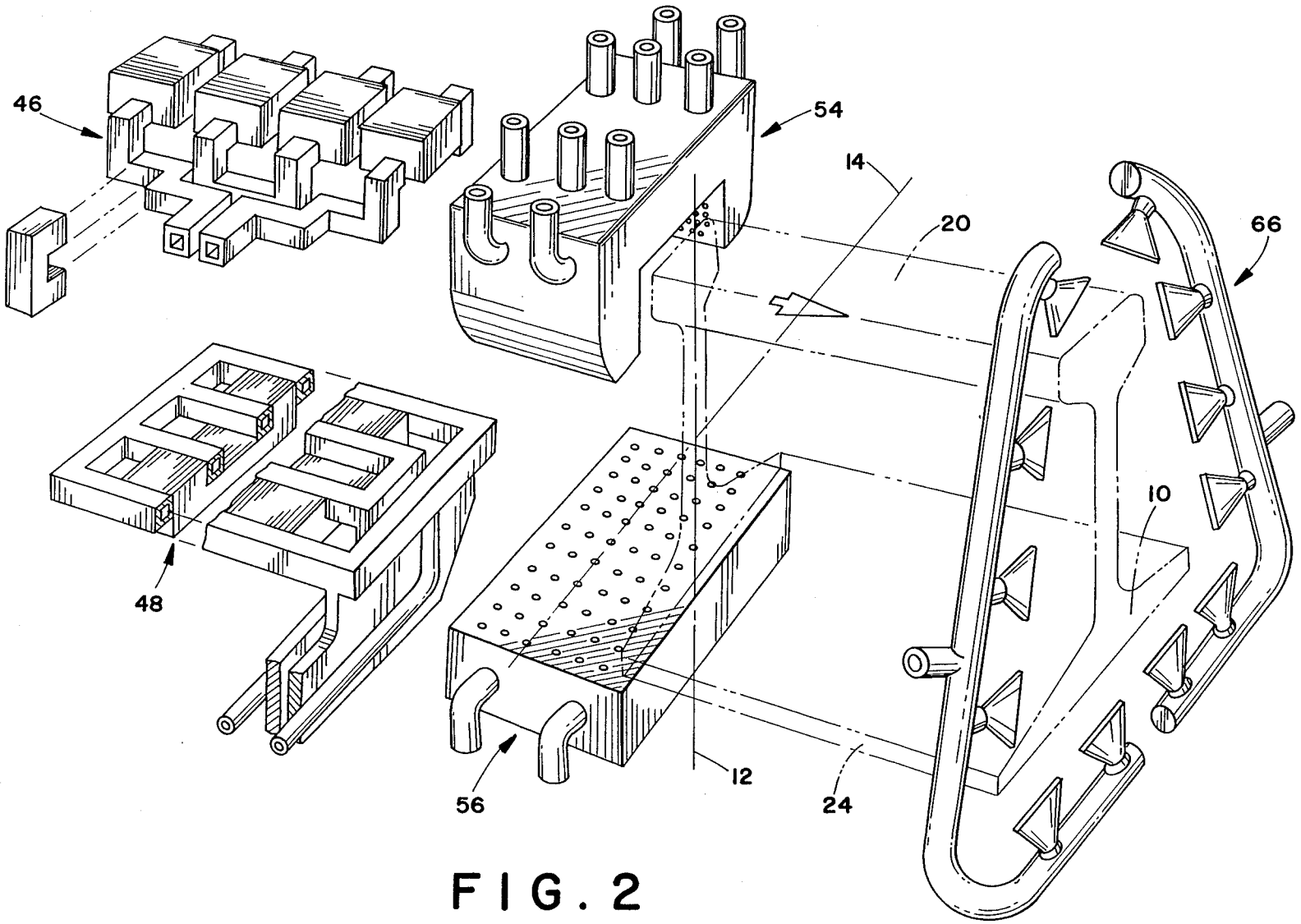
FIG. 2 is an exploded perspective view of a portion of the assembly of FIG. 1 with selective portions thereof in cross-section for ease of illustration.

With particular reference to FIG. 2, a more detailed and exploded perspective view of the subject invention is shown for particularly showing the heating, quenching and cooling steps of the subject invention, with the rail 10 shown in phantom along with its neutral axes 12, 14 for ease of illustration. Hardening of the rail 10 is effected by raising the temperature of the rail head portion above the metallurgical transformation temperature and quenching the head portion in a known manner to form a hardened head portion 20 with improved wear characteristics. It is a feature of the invention that the heat treatment is done in a balanced manner about the neutral axes 12, 14 in order to maintain the straightness of the rail 10 and reduce subsequent mechanical distortion compensating steps such as bending or stretching of the rail. Heating of the rail head and flange portions 20, 24 to a temperature above the metallurgical transformation temperature is accomplished by conventional water-cooled inductors 46, 48 which heat the head and flange portions by induction heating. Induction heating offers the advantages of a controllable heating step for precision control of temperature and metallurgical transformation depth. Balanced thermal deformation about the horizontal axis is accomplished by substantially simultaneous heating of the head and flange portions in a manner that produces a balance in the thermal deformation forces. This is achieved by controlling the volume of metal heated in the head to a particular temperature and the volume of metal heated in the flange to another temperature so that bending forces are generally equal and opposite. Balanced thermal deformation about the vertical axis 12 is accomplished by the symmetry of the rail and the heating elements.

After raising the temperature of the rail to a preselected level above the metallurgical transformation temperature, the rail is quenched with localized air quenches 54, 56 to reduce the temperature of the head portion 20 to a preselected level to accomplish the hardening of the rail head portion 20 in the desired manner. Just as the inductors are aligned in a generally opposite manner, the air quench chambers 54, 56 are similarly oppositely aligned and the flange quench 56 quenches the flange in a manner to achieve again, a balanced thermal deformation about the neutral axes. It should be noted that the quenching of the head portion 20 is performed in a precise manner to produce the desired metallurgical structure, and consequent hardness, in the rail head portion. Quenching of the flange portion 24 is not so concerned with achieving a desired metallurgical structure in the flange as it is with balancing the thermal deformation of the flange with the thermal deformation of the head portion 20 so that they are equal and thereby avoid distorting the rail 10. A last step in the method of the subject invention involves cooling the rail down to substantially room temperature by an overall water-spray 66, which again, is performed in a manner to maintain the balanced thermal deformation about the neutral axes.

Figure 3A:
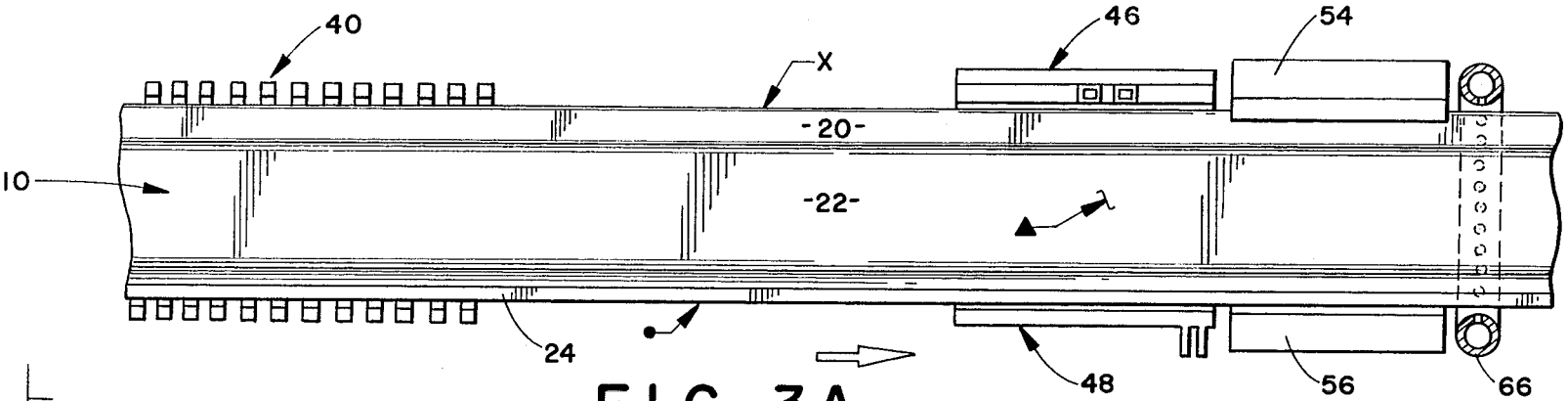
FIG. 3A is an elevational view of a rail in a heat treating assembly formed in accordance with the present invention wherein the elements of the assembly are shown in partial section for ease of illustration; and, FIG. 3B is a graph in association with the rail of FIG. 3A particularly illustrating the temperatures generated in the rail by the elements of the heat treating assembly.
Figure 3B:
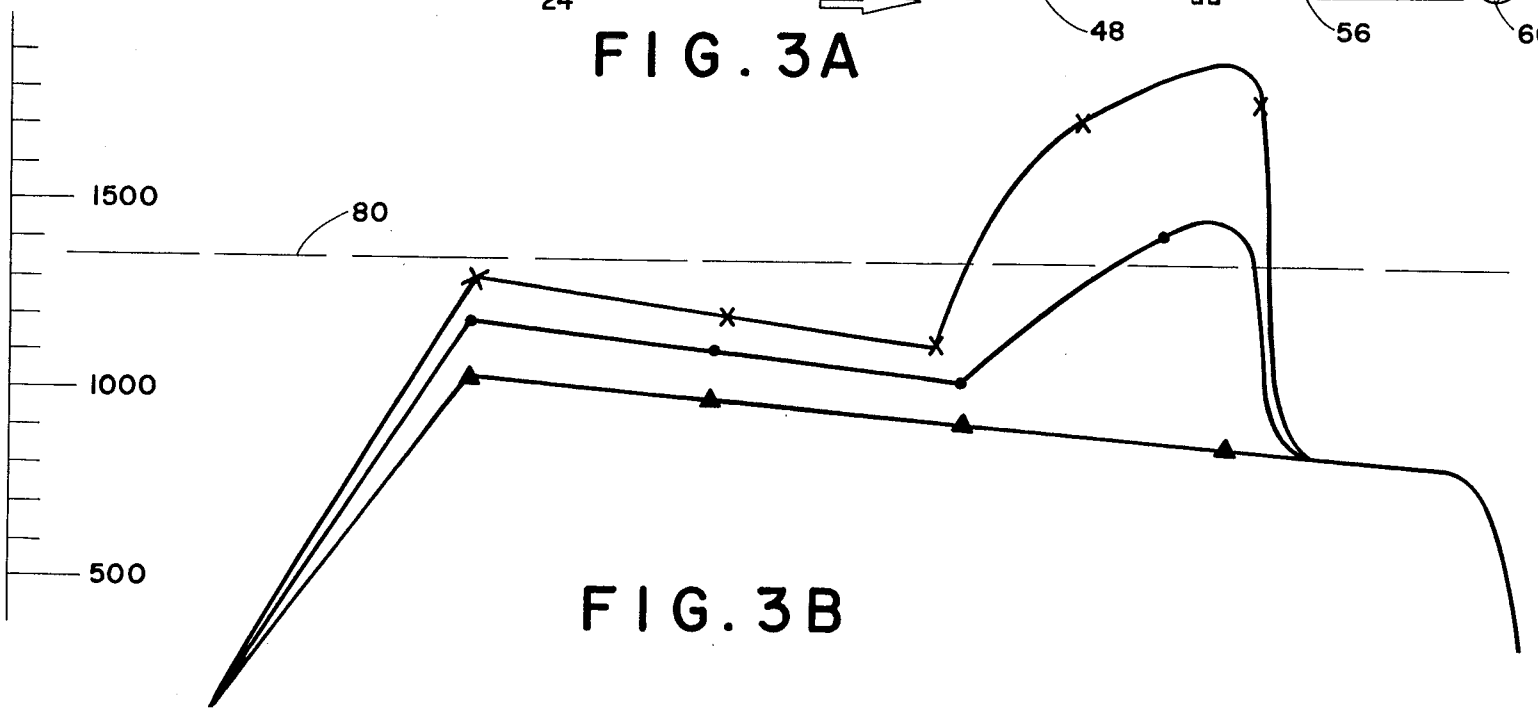

With particular reference to FIGS. 3A and 3B, the temperature levels achieved in the rail 10 as it is treated in the assembly 16 are graphically illustrated. The temperatures in the graph of the head portion 20 are denoted by X's, the temperatures of the web 22 are denoted by a triangle line and the temperature of the flange portion 24 are denoted with a dot line. The dashed line 80 generally indicates the metallurgical transformation temperature. As the rail moves through the preheat coil 40, as shown in FIGURE 3A, the temperature of all three portions of the rail 10 are raised to a temperature below the metallurgical transformation temperature, in this example, approximately 1000° F. The metallurgical transformation temperature is the temperature above $A_s$ for any alloy of steel. Preheating of the rail 10 by preheat coil 40 allows for a preliminary thermal expansion of the entire rail and avoids the problems of excessive residual stresses forming in the final product. It is also within the scope of the invention to process rail which has residual heat from the rolling process. The residual heat may reduce or entirely eliminate the need for a preheating step. After preheating, the heating of the head portion 20 and the flange portion 24 to a temperature above the metallurgical transformation temperature by inductors 46, 48 raises the temperature of the head portion to approximately 1900° F. and the flange portion to approximately 1500° F. These temperatures are specified as exemplary temperatures only. Specific heating temperatures will vary in acordance with the steel alloy employed and the heat treating needs for the rail product. The quench chambers 54, 56 direct the quench medium to the head portion and the flange portion to cool them to approximately 1000° F., and the cool down spray 66 cools the entire rail to approximately room temperature. The quench medium can be air or mist, or alternatively any type of conventionally known quenching means.

It is noted that throughout the entire operation of the method, a balanced thermal and metallurgical deformation occurs about the rail neutral axes 12, 14 so the rail upon exiting the cool down spray 66 has a straightness generally equivalent to the straightness of the rail as it entered the heat treating assembly 16. The balanced thermal deformation of the entire rail 10 allows for heat treating of a high carbon steel rail to provide an improved wear-resistant rail and reduces the subsequent steps of conventional heat treating techniques which include a bending or stretching step to mechanically compensate for distortion created during conventional heat treating methods.

The invention has been described with reference to the preferred embodiments. Obviously, modifications and alterations will occur to others upon the reading and understanding of the specification. It is our intention to include all such modifications and alterations in so far as they come within the scope of appended claims or the equivalents thereof.

Having thus described our invention, we now claim:

1. A method for heat treating a rail, said rail having head, web and flange portions and a vertical and horizontal neutral axes, to produce a rail having a metallurgical structure with high wear resistance comprising:

a first step of preheating the rail to a first preselected temperature below the metallurgical transformation temperature;

a second step of heating the head portion and the flange portion of the rail to preselected temperatures above the metallurgical transformation temperature, for balanced thermal deformation of the rail about the axes;

a third step of quenching the rail head and flange portions to produce a desired metallurgical structure in the rail with balanced thermal deformation of the rail about the axes during the quenching process; and, a fourth step of after-cooling the entire rail from below the transformation temperature to ambient room temperature, wherein the balance of thermal deformation about the axes is maintained.

2. The method as described in claim 1 wherein the first step comprises an overall heating of the rail to a temperature of approximately 1000° F.

3. The method as described in claim 1 wherein the second step comprises heating the head portion to approximately 1900° F. and the flange portion to approximately 1500° F.

4. The method as described in claim 3 wherein the second step comprises induction heating of the head and flange portions.

5. The method as described in claim 1 wherein the third step comprises quenching the head and flange portions to approximately 1000° F.

6. The method as described in claim 5 wherein the third step comprises localized air quenching of the head and flange portions.

7. The method as described in claim 1 wherein the fourth step comprises an overall spray quench.

* * * * *